US005353559A

United States Patent [19]

Murota et al.

[11] Patent Number: 5,353,559

[45] Date of Patent: Oct. 11, 1994

[54] ANTI-EARTHQUAKE BEARING APPARATUS

[75] Inventors: Nobuo Murota; Keizo Tatsunami, both of Yokohama; Koji Ishii, Kanagawa; Atsuhiko Yasaka, Tokyo; Masao Iizuka, Inagi; Jun Tagami, Tama, all of Japan

[73] Assignees: Bridgestone Corp.; Kajima Corp., both of Tokyo, Japan

[21] Appl. No.: 748,628

[22] Filed: Aug. 22, 1991

[30] Foreign Application Priority Data

Aug. 22, 1990 [JP] Japan ..... 2-220863

[51] Int. Cl.[5] ..... E04H 9/02

[52] U.S. Cl. ..... 52/167 E; 248/562; 248/636

[58] Field of Search ..... 52/167, 523, 2.11, 2.22, 52/2.13, 167 RM, 167 RS, 167 RA, , 167 E, 167 EA, 393, 403; 248/562, 636, 638; 267/35, 148, 152, 153; 428/36.91, 109, 113; 403/5

[56] References Cited

U.S. PATENT DOCUMENTS 951,028 3/1910 Schar ..... 52/167 RS
1,651,411 12/1927 Porter ..... 52/167 RA
4,917,211 4/1990 Yamada et al. .
4,942,075 7/1990 Hartel et al. .
5,071,261 12/1991 Stuve ..... 384/36

FOREIGN PATENT DOCUMENTS 2035012 1/1972 Fed. Rep. of Germany .
629045 7/1985 Japan .
9045 1/1987 Japan .
0666266 6/1979 U.S.S.R. ..... 52/167 RS

*Primary Examiner*—Michael Safavi
*Attorney, Agent, or Firm*—Knobbe, Martens, Olson & Bear

[57] ABSTRACT

An anti-earthquake bearing apparatus for bearing the weight of a structure and reducing the vibration energy propagating to the structure by using bearing bodies disposed between the structure and a foundation or another structure has spherical bag-like bearing bodies serving as said bearing bodies formed by sealing a fluid, rubber-like solid or gas into bags constituted by a rubber-sheet material reinforced with fiber. Each bag-like bearing body is provided with charging/discharging ports. Recesses for preventing positional shift of said bag-like bearing bodies are formed on the bottom surface of the structure and on the upper surface of the foundation.

14 Claims, 8 Drawing Sheets

ANTI-EARTHQUAKE BEARING APPARATUS

BACKGROUND OF THE INVENTION

1. Field of the Invention

The present invention relates to the construction of an anti-earthquake bearing apparatus for use between buildings or structures such as ground facilities or machinery, and foundations or other structures, in a manner capable of avoiding earthquakes.

2. Description of the Related Art

An anti-earthquake bearing apparatus provided with elastic bearing bodies mounted between a structure and its foundation or between the structure and another structure to reduce the response acceleration, and at the same time prevent the resonance of the structure due to an external force such as an earthquake is employed to reduce the energy propagating to the structure such as building and machinery when an earthquake or the like has occurred.

Various elastic bearing bodies have been proposed including, for example those using springs, vibration proof rubber or laminated rubber, and those using various kinds of dampers in combination with the elastic bearing bodies.

A laminated rubber in which elastomer layers such as rubber and reinforcing plates such as metallic plates, are alternated with each other to be integrated in a laminated manner is disclosed, for example, in Japanese Patent Laid-Open Application No. 61-261845 and in Japanese Patent Laid-Open No. 61-14340.

However, if the spring constant in the case of using vibration proof rubber is set to a higher value in order to bear a large load, the expansion of natural period is insufficient causing a lack of earthquake response reduction effect, conversely, if the spring constant is set to a low value, there will be insufficient strength for bearing a structure with a large load.

Further, when using the above described single elastic bearing body with a single value of natural vibration, it is impossible to prevent a resonance for a broad frequency band width of an earthquake.

Furthermore, when using elastic bearing bodies in combination with dampers, the mechanical structure in such composition becomes complicated, whereby time and labor for maintenance are required and higher costs result.

The above described laminated rubber have been proposed for use in anti-earthquake bearing apparatus capable of bearing a heavy weight and increasing the allowable displacement in the horizontal direction.

In an anti-earthquake bearing apparatus using the above described laminated rubber, however, though an excellent response reduction effect is achieved with respect to the horizontal vibration of an earthquake, it is still insufficient in expanding the natural cycle. A technical problem is created such that the response reduction effect in the vertical direction is low. There is also a technical problem that it is difficult to achieve a sufficient response reduction effect for an earthquake vibration having various frequency components because the vibrating system has a relatively short (about 2 to 3 seconds) natural cycle.

SUMMARY OF THE INVENTION

An object of the present invention is to provide an anti-earthquake bearing apparatus in which spherical bag-like bearing bodies made by sealing a fluid, rubber-like solid or gas into bags of a rubber-like fiber-reinforced sheet material are arranged to support the weight of the structure. The natural cycle of the spring system including the structure itself may be made sufficiently longer or a spring system without a specific natural cycle may be formed to enhance anti-earthquake and vibration proof effect.

Another object of the present invention is to provide an anti-earthquake bearing apparatus in which a sufficient anti-earthquake and vibration proof effect on the structure may be achieved not only in the horizontal direction but also in the vertical direction.

Still another object of the present invention is to provide an anti-earthquake bearing apparatus in which the vibration characteristic of the spring system including the structure may readily be adjusted, whereby anti-earthquake and vibration proof, results may be real, and for a variety of vibrational disturbances.

A further object of the present invention is to provide an anti-earthquake bearing apparatus of which installation and maintenance may readily be performed by disposing said bag-like bearing bodies in a compressed and deformed state and in a manner capable of being rolled.

A still further object of the present invention is to provide an anti-earthquake bearing apparatus of which installation and maintenance may be even more readily performed by providing charging/discharging ports for said fluid, rubber-like solid or gas on the bag-like bearing body.

Figure 1:
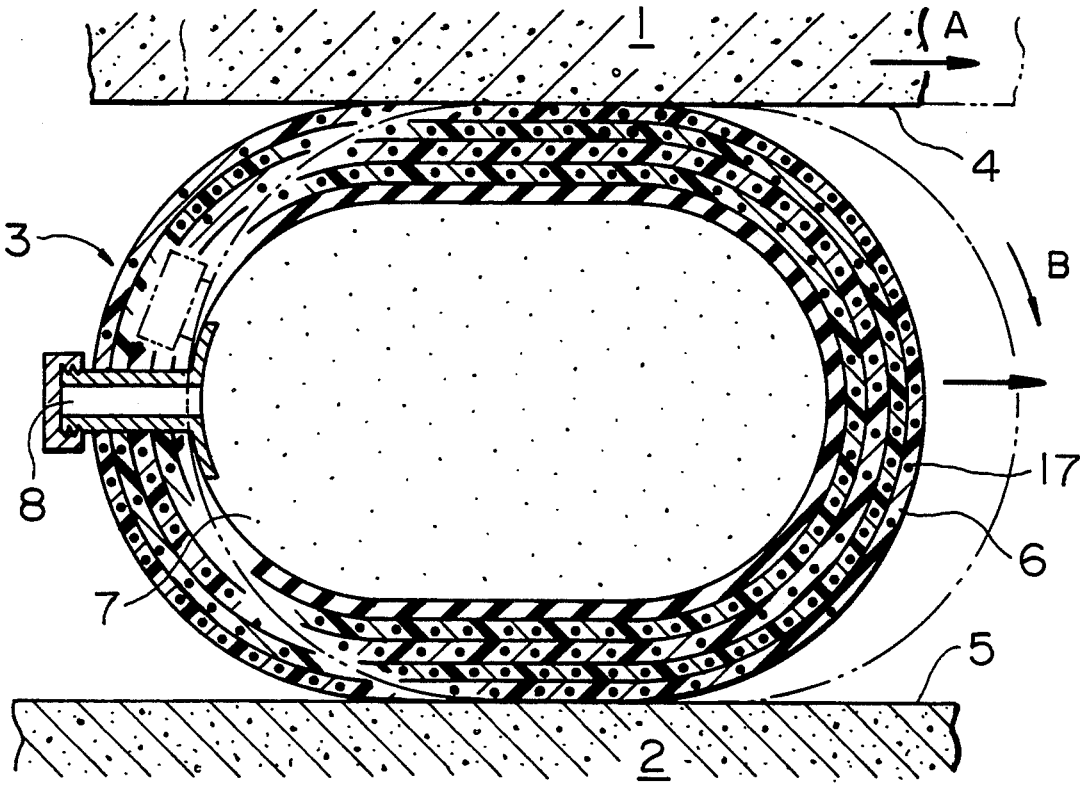
FIG. 1 is a longitudinal section showing certain portions of an embodiment of anti-earthquake bearing apparatus to which the present invention is applied.
Figure 12:
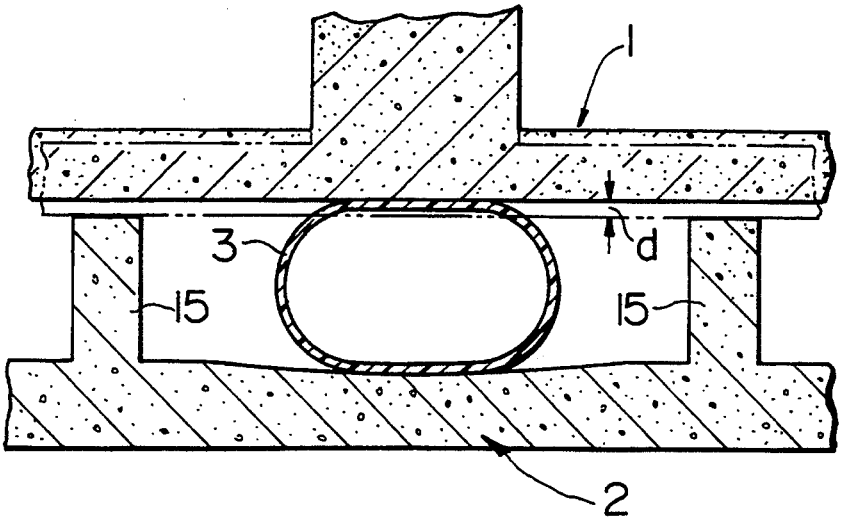
Figure 9:
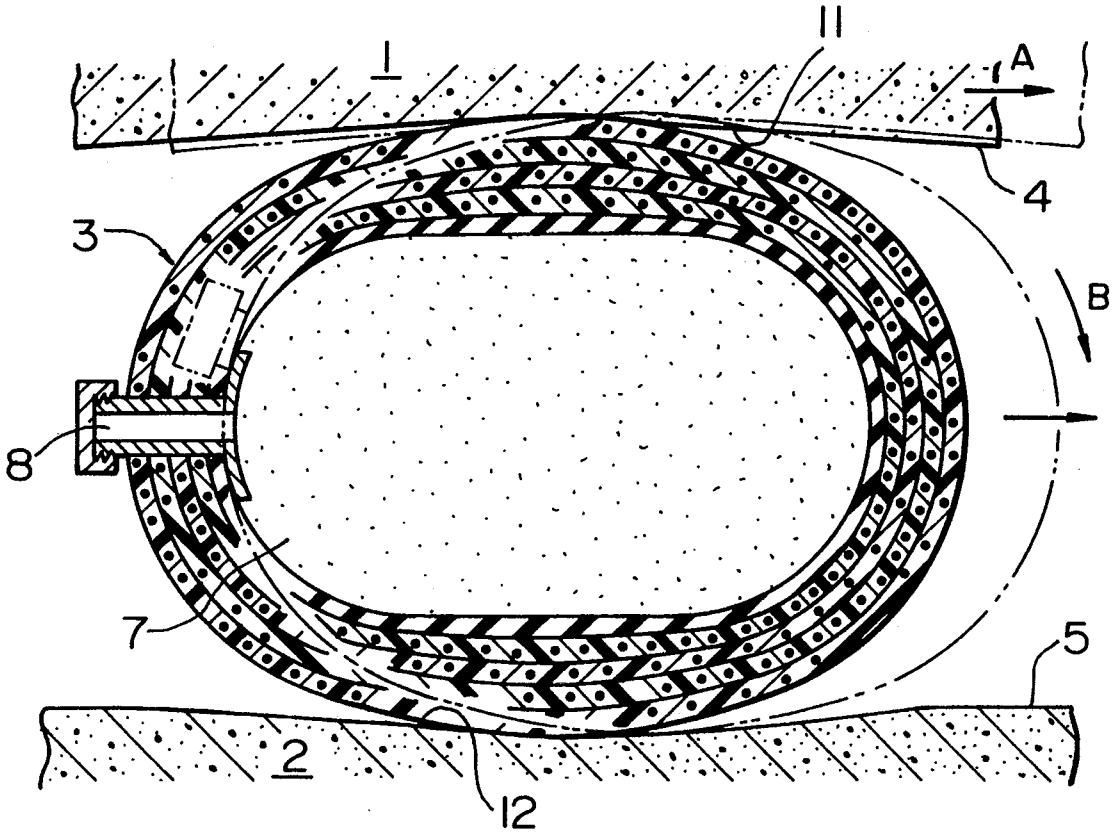
Figure 10:
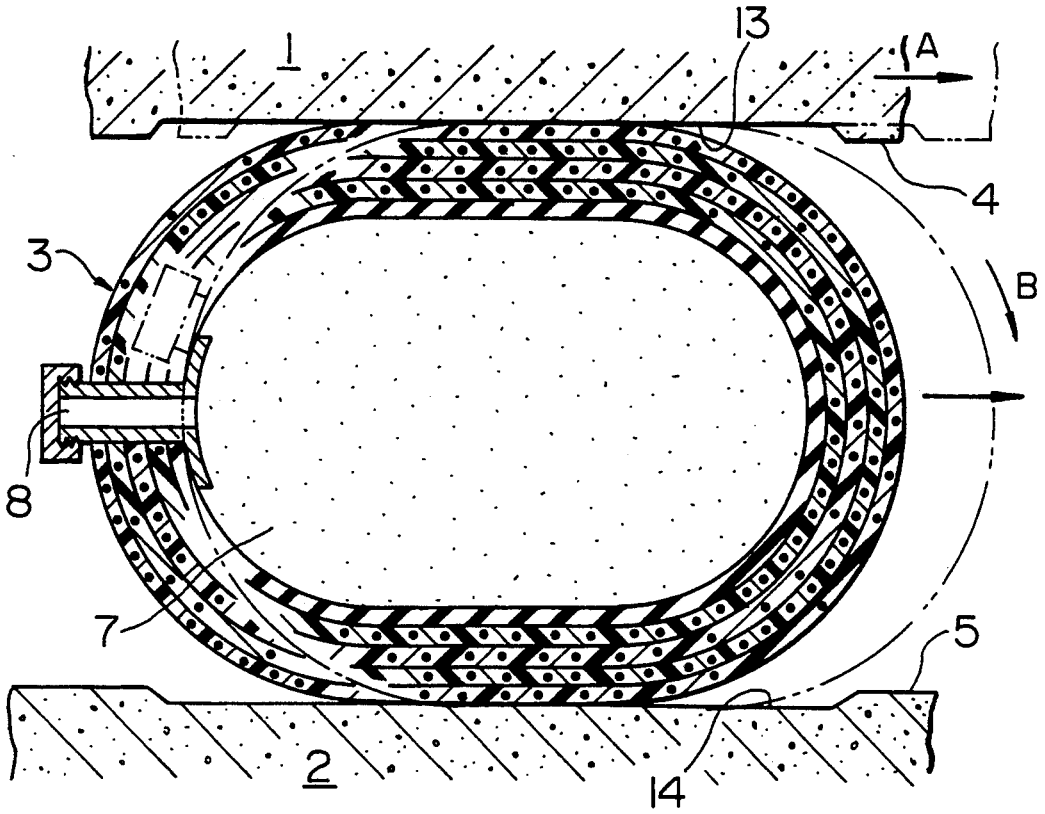
Figure 11:
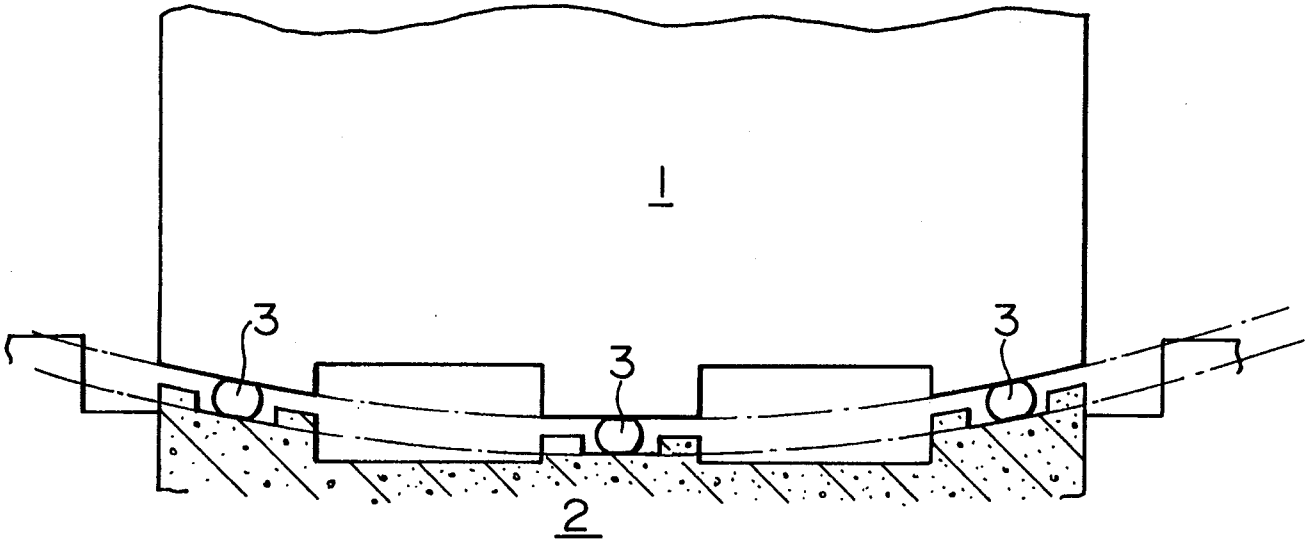

Each of FIGS. 9 and 10 is a longitudinal section corresponding to that of FIG. 1 showing the construction of certain portions of another embodiment of an anti-earthquake bearing apparatus to which the present invention is applied;

FIG. 11 is a diagrammatic longitudinal section showing still another embodiment of the anti-earthquake bearing apparatus to which the present invention is applied; and FIG. 12 is a diagrammatic partial longitudinal section showing an example of installation process of the anti-earthquake bearing apparatus or which the present invention is applied.

DETAILED DESCRIPTION OF THE PREFERRED EMBODIMENT

Embodiments of the present invention will now be described with reference to the drawings.

Figure 2:
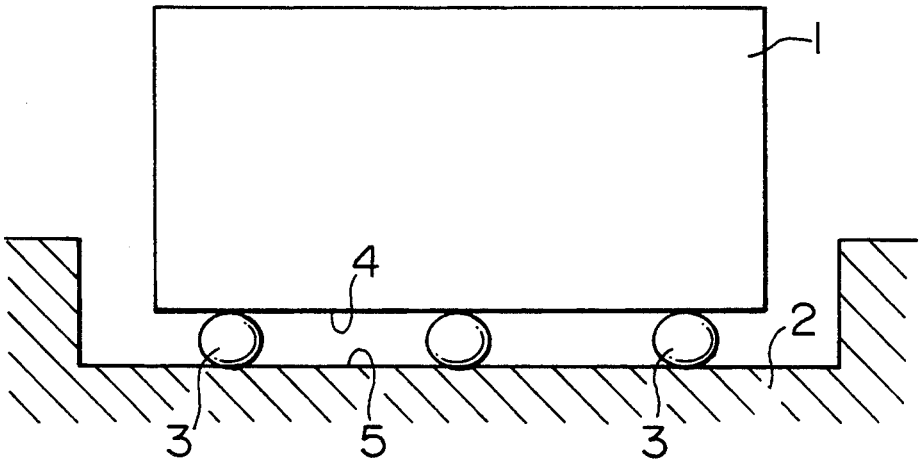
FIG. 2 is a diagrammatic side view showing an embodiment of the anti-earthquake bearing apparatus to which the present invention is applied.
Figure 3:
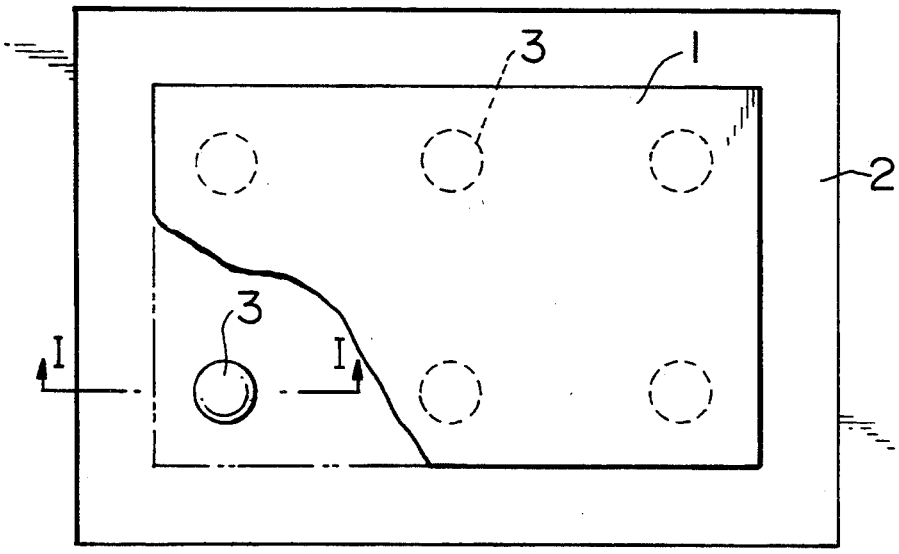
FIG. 3 is a partially fragmented plan view of the anti-earthquake bearing apparatus as shown in FIG. 2.

FIGS. 2 and 3 show an example of the anti-earthquake bearing apparatus to which the present invention is applied. A plurality of bag-like bearing bodies 3 are disposed at predetermined intervals between the structure 1 and a foundation or another structure 2. Thus an anti-earthquake bearing apparatus is formed such that the structure 1 such as a building or machinery is supported by way of the bag-like bearing bodies 3 on the foundation or another structure 2, reducing the vibration energy propagating thereat.

The "structure" described above refers generally to: such architectures as a building or a construction having roofs; such public works as bridges and roads; buildings for computer or nuclear facilities; and various machineries. In the following description, the above described "foundation or another structure 2" for bearing the structure 1 will be simply referred to as "foundation 2".

FIG. 1 is a partial longitudinal section showing one of the above described bearing bodies 3 along line I—I in FIG. 3.

In FIGS. 1—3, the above described bag-like bearing bodies 3 are disposed between the flat surfaces formed parallel to each other respectively at a bottom surface 4 of the structure 1 and an upper surface 5 of the foundation 2.

Each bag-like bearing body 3 is constructed by a spherical bag such that a fluid, rubber-like solid or gas 7 is sealed in a bag 6 which is constituted by rubber-like sheet material reinforced with fiber. The weight of the structure 1 is born by the internal pressure (compressive reaction force) thereof.

Further, each bag-like bearing body 3 is disposed in a compressed and deformed state by the self-weight of the structure 1. When the structure 1 is displaced horizontally (arrow A) in relation to the foundation 2 due to an earthquake or the like, each bag-like bearing body 3 is capable of following the displacement of the structure 1 while rolling in the direction of arrow B.

Said bag 6 has a reinforced composition made for example by integrating nylon fiber, carbon fiber, Kevlar fiber or metallic fiber or the like into a rubber-like elastic material.

Further, the bag 6 has a predetermined number (usually one or two) of charging/discharging ports (mouthpiece) 8 so as to be charged with the above described contained matter 7 and pressurized at the time of installation to bear the structure 1. Also, even after the installation, the internal pressure may be changed to adjust the spring characteristic by making an addition or subtraction to/from the contained matter 7.

Such solids as rubber having a low elastic modulus or such gases as the air may be used as the contained matter 7 as well as various fluids including viscoelastic material such as water, oil and asphalt.

Figure 4:
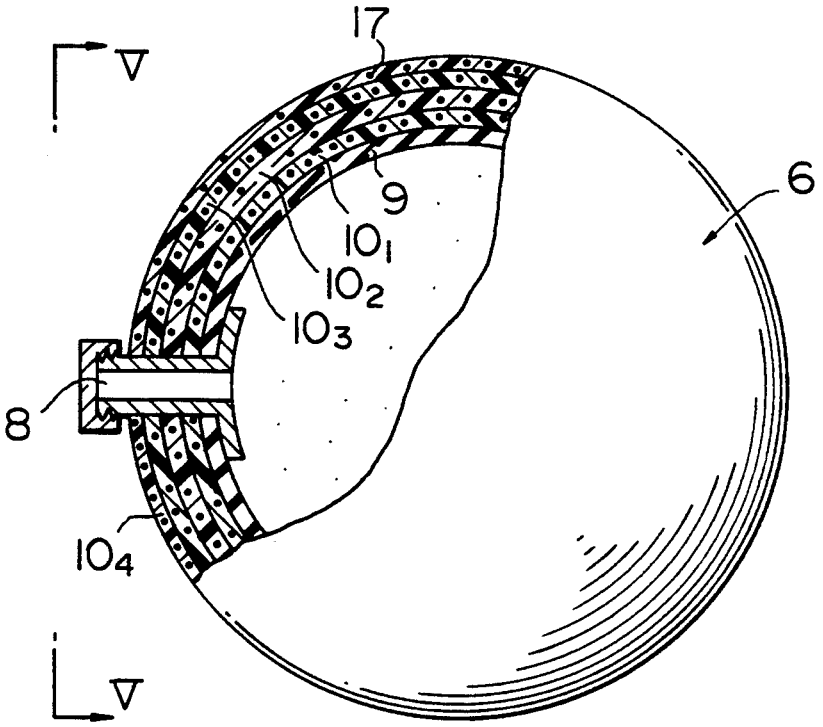
FIG. 4 is a partially fragmented side view showing an example of the structure of the bag of the bag-like bearing body in FIG. 1.
Figure 5:
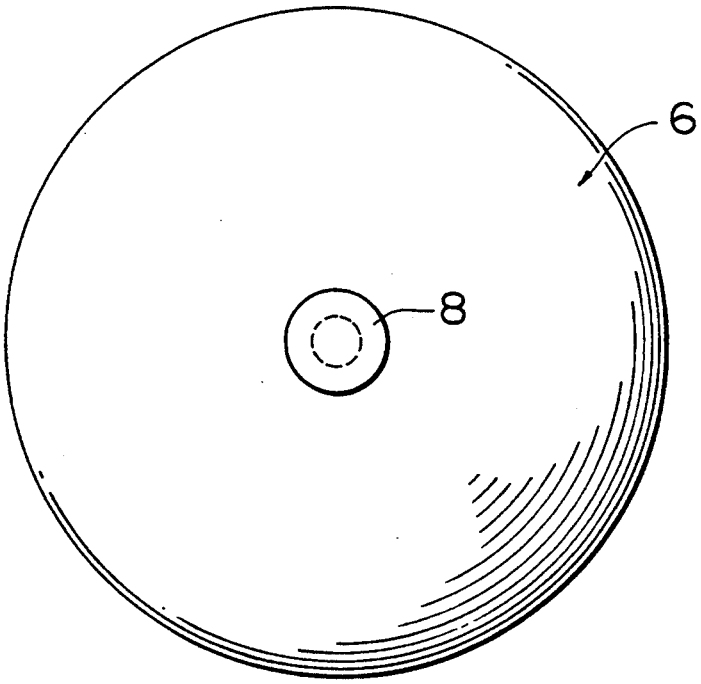
FIG. 5 is a front view as seen from line V—V in FIG. 4.

FIG. 4 is a partially fragmented side view showing an example of the construction of the bag 6 which is constituted by rubber-like sheet material reinforced with fiber as described above, and FIG. 5 is a front view as seen from line V—V in FIG. 4.

As shown in FIG. 4, the bag 6 is constructed such that fiber-reinforced rubber layers $\mathbf{10_1}$–$\mathbf{10_4}$ consisting of four layers are integrally fitted together for example by adhesion or vulcanization to the surface of an inner bag 9 which is constituted only by an elastic material such as rubber.

Figure 6:
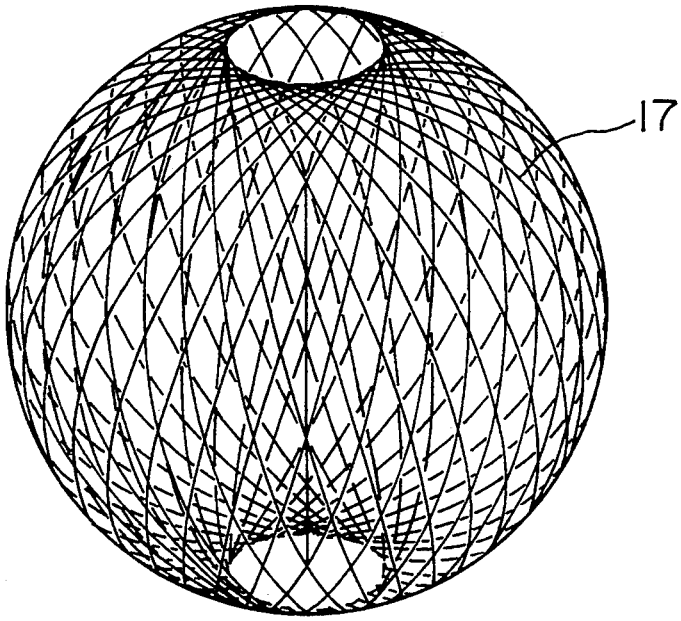
FIG. 6 is a perspective view showing an example of the arrangement of reinforcing fibers of the fiber-reinforced rubber layer in FIG. 4.

FIG. 6 is a perspective view showing an example of the arrangement of cord (reinforcing fibers) 17 in each of the fiber-reinforced rubber layers $\mathbf{10_1}$–$\mathbf{10_4}$. In the present embodiment, the cord 17 such as of nylon fiber, carbon fiber, Kevlar fiber, or metallic fiber as described above is wound so as to form 2 or 3-4 layers along a spherical surface as shown in the figure.

Note that, instead of the cord 17 as shown in FIG. 6, woven fabrics or short fibers may also be used as the reinforcing fiber.

Figure 7:
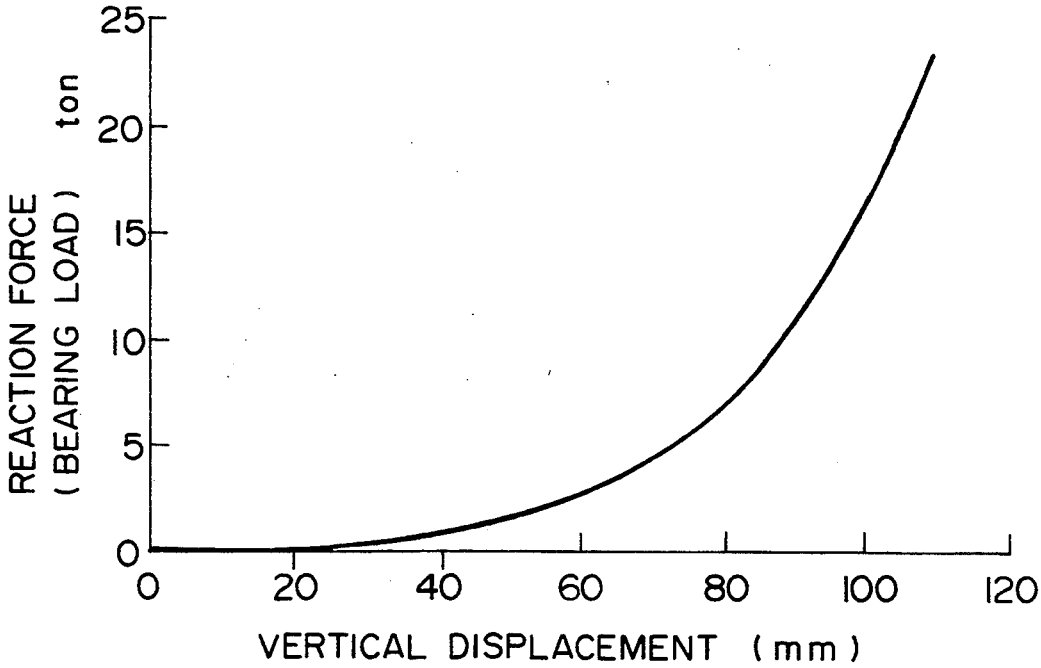
FIG. 7 is a graph showing an example of displacement characteristic due to load in the vertical direction of the bag-like bearing body in FIG. 1.
Figure 8:
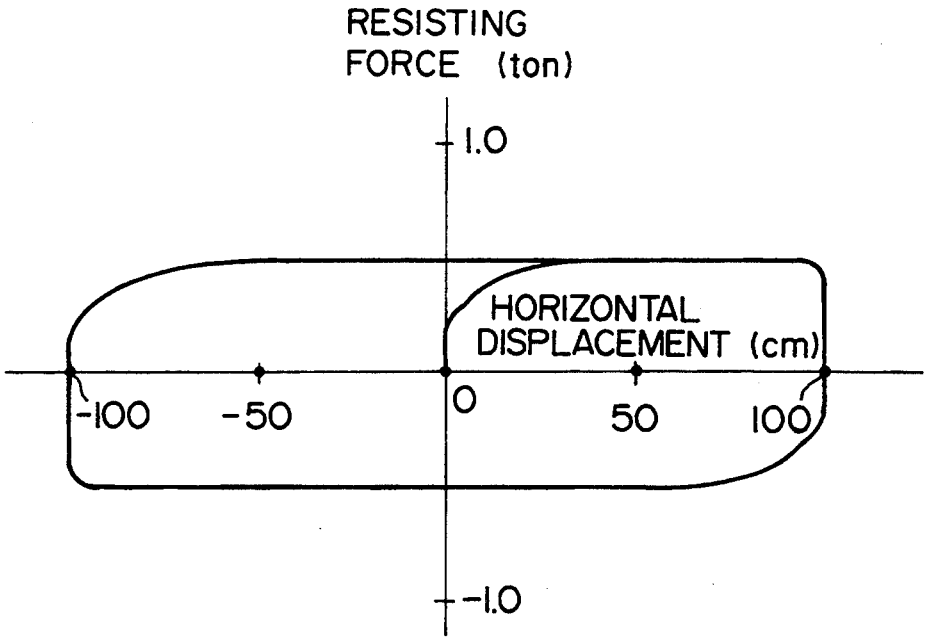
FIG. 8 is a graph showing the characteristic of resisting force in the horizontal direction against the horizontal displacement at the time of rolling of the bag-like bearing body in FIG. 1.

FIG. 7 is a graph showing the characteristic of reaction force (bearing load) in the vertical direction of the above described bag-like bearing body (spherical bag) 3 with respect to a vertical displacement, and FIG. 8 is a graph showing the characteristic of the resisting force (frictional force, attenuating force) in the horizontal direction with respect to a horizontal displacement at the time of rolling of said bag-like bearing body.

According to the embodiment described with reference to FIGS. 1–8, in an anti-earthquake bearing apparatus for reducing vibration energy propagating to the upper structure 1, spherical bags (bag-like bearing bodies) 3, are made by sealing a fluid, rubber-like solid or gas 7 in the bag 6 which is constituted by fiber-reinforced rubber-like sheet material 9, $\mathbf{10_1}$–$\mathbf{10_4}$. The spherical bags 3 are disposed in a predetermined arrangement between the upper structure 1 and the lower foundation or structure 2 to bear the weight of the upper structure 1 with the spherical bags 3 in a compressed and deformed state and being capable of rolling. Further each spherical bag 3 is provided with charging/discharging ports 8 for the fluid, rubber-like solid or gas 7. The following advantages have thus been obtained.

(i) The natural period of the spring system consisting of the structure 1 and the spherical bags 3 may be made much longer compared to that of a conventional anti-earthquake bearing apparatus constituted by laminated rubber and it is possible not to have any specific natural period. It is thus possible to obtain an anti-earthquake bearing apparatus which is capable of maintaining a high degree of anti-earthquake effect on the structure 1 during vibrations of a wide range of frequencies.

(ii) It is possible to obtain an anti-earthquake bearing apparatus capable of exhibiting an anti-earthquake effect not only in the horizontal direction but also in the vertical direction.

(iii) By selecting the combination of fluids such as water and viscoelastic material, solid such as rubber, or gases as the air, to be charged into the bag 6, the elastic modulus of the bag 6, and the internal pressure to be employed, it is possible to readily adjust the anti-earthquake characteristics such as the spring characteristic, attenuating force and the trigger level. It is thus possible to obtain an anti-earthquake bearing apparatus which is capable of achieving an excellent anti-earthquake and vibration proof effect in various vibration systems.

(iv) Since each spherical bag 3 has a suitable degree of rolling resistance, it will be not displaced due to an external force such as wind load that is smaller than the rolling resistance. It is thus possible to obtain an anti-earthquake bearing apparatus having a trigger characteristic.

(v) It is possible to obtain an anti-earthquake bearing apparatus exhibiting excellence in the readiness of installment and maintainability.

Each of FIGS. 9 and 10 is a partial longitudinal section showing certain portions of another embodiment of anti-earthquake bearing apparatus according to the present invention.

In the embodiment as shown in FIG. 9, recesses 11 and 12 are formed at predetermined positions respectively on the bottom surface 4 of the upper structure 1 and on the upper surface 5 of the lower foundation 2, i.e., the position at which the bag-like bearing body (spherical bag) 3 is disposed.

On the other hand, in the embodiment as shown in FIG. 10, recesses 13 and 14 are formed at predetermined positions respectively on the bottom surface 4 of the upper structure 1 and on the upper surface 5 of the lower foundation 2, i.e., the position at which the bag-like bearing body (spherical bag) 3 is disposed.

Each of the upper and lower recesses 11 and 12 as shown in FIG. 9 has a shallow cone-shaped taper surface capable of holding the spherical bag 3 in a stable state at the center portion thereof.

Each of the upper and lower recesses 13 and 14 as shown in FIG. 10 is formed by a flat surface of predetermined extent(usually a circular range) having a predetermined depth.

Though having differences as described, the embodiments as shown in FIGS. 9 and 10 are substantially identical in their construction of the other portions to the foregoing embodiment as shown in FIGS. 1–8. Thus their corresponding components are denoted by the same reference numerals and detailed description thereof will be omitted.

According to the embodiments as shown in FIG. 9 and 10, in addition to the advantages (i)–(v) of the embodiment described with reference to FIGS. 1–8, another advantage is obtained such that positional shift of the spherical bags 3 may be prevented even in the worst case where large earthquakes are repeated.

Further, according to the embodiments as shown in FIGS. 9 and 10, it is possible to obtain a restoring capability by which the structure 1 is securely brought back to its original position after the earthquake even when the spherical bags 3 are repeatedly rolled at the time of earthquake.

FIG. 11 is a longitudinal section showing still another embodiment of the anti-earthquake bearing apparatus to which the present invention is applied.

In the present embodiment, all the spherical bags (bag-like support bodies) 3 to be mounted between the structure 1 and the foundation 2 are disposed on surfaces of concentric circular arcs (a portion of the same spherical surface).

A restoring capability by which the structure 1 is brought back to its original position after an earthquake may be obtained also by the present embodiment in a similar manner to the embodiments as shown in FIG. 9 and 10.

It should be noted that, while in the embodiments as shown in FIGS. 9 and 10, the recesses 11 and 12, or the recesses 13 and 14 provided above and below have the same configuration, optional embodiments are possible as required for example by forming recesses so that the upper one and the lower one are different in configuration or by forming a recess only at one side.

FIG. 12 is a partial longitudinal section showing an example of installing process of an anti-earthquake bearing apparatus according to the present invention.

In the example of installing process as shown in FIG. 12, method of construction is such that: reinforced concrete pedestals 15 are previously formed at predetermined positions on the upper surface of the foundation or lower structure 2; the upper structure 1 is first constructed on the pedestals 15, and uncharged spherical bags 3 are then inserted between the pedestals 15; and, thereafter, by charging the contained matter 7 into the spherical bags 3, the structure 1 is hoisted to be supported at a predetermined height where a predetermined gap d occurs therefrom to the pedestals 15.

As has been described in detail, according to the present invention, an anti-earthquake bearing apparatus in which bearing bodies are disposed between the structure 1 and the foundation 2 or between the structure 1 and another structure 2 to reduce the vibration energy propagating therebetween is constructed such that spherical bag-like bearing bodies 3 obtained by sealing a fluid, rubber-like solid or gas into bags 6, which are constituted by a rubber-like sheet material reinforced with fiber, are used as said bearing bodies so as to bear the weight of the structure 1 by the bag-like bearing bodies 3. It is thus possible to make sufficiently longer the natural period of the spring system including the structure 1 or to cause the system not to have any specific natural period, and furthermore a sufficient anti-earthquake and vibration proof effect may be achieved not only in the horizontal direction but also in the vertical direction.

Further, according to the present invention, an anti-earthquake bearing apparatus by which the spring characteristic and the attenuation characteristic of the spring system including the structure 1 may be readily adjusted so that effective anti-earthquake and vibration proof results are realised for a variety of vibrational disturbances.

Moreover, since said bag-like bearing bodies 3 are disposed in a compressed and deformed state and in a manner capable of being rolled, it is possible to improve the installability and maintainability of the anti-earthquake bearing apparatus.

In addition, since each of the bag-like bearing bodies 3 is provided with charging/discharging ports for the fluid, rubber-like solid or gas, the adjustment of the spring characteristic and the attenuation characteristic may readily be performed, further improving the installability and maintainability.

What is claimed is:

1. An anti-earthquake bearing apparatus having bearing bodies disposed between an upper structure and a foundation to reduce vibration energy propagating therebetween, said anti-earthquake apparatus comprising:

a plurality of spherical bag-like bearing members used as said bearing bodies as a sole support of said upper structure, said bearing members being filled therein with fluid material, and said bearing members comprising rubber-like sheet material reinforced with fiber, a plurality of recesses for allowing limited positional shift of said bearing members within said recesses, said recesses being provided in said foundation, and said bearing members being deformed in a vertical direction in response to the weight of said upper structure and vibrations caused by said earthquake, and said bearing members rolling in a horizontal direction within said recessed following a displacement between said upper structure and said foundation.

2. An anti-earthquake bearing apparatus of claim 1, wherein said bag-like bearing members are provided with charging/discharging ports for said fluid material.

3. An anti-earthquake bearing apparatus of claim 1, wherein said bearing members have a reinforced structure by integrating nylon fiber, carbon fiber, Kevlar fiber, or metallic fiber into said rubber-like sheet material.

4. An anti-earthquake bearing apparatus of claim 1, wherein said fluid material is water.

5. An anti-earthquake bearing apparatus of claim 3, wherein said reinforced structure comprises a plurality of fiber-reinforced rubber layers attached to a surface of an innermost layer made of elastic material such as rubber by using adhesion.

6. An anti-earthquake bearing apparatus of claim 1, wherein each of said recesses is formed by a shallow cone-shaped taper surface.

7. An anti-earthquake bearing apparatus of claim 1, wherein each of said recesses is formed by a flat surface having a predetermined depth.

8. An anti-earthquake bearing apparatus of claim 1, wherein said bearing members are disposed in said plurality of recesses, said plurality of recesses having spherical surfaces and being formed on said foundation, said upper structure has a spherical surface of substantially similar curvature to that of said spherical surfaces of said recesses so that said bearing members support said upper structure substantially in parallel to said spherical surfaces in said recesses.

9. An anti-earthquake bearing apparatus of claim 1, wherein said recesses are provided in said upper structure.

10. An anti-earthquake bearing apparatus of claim 1, wherein said fluid material is oil.

11. An anti-earthquake bearing apparatus of claim 1, wherein said fluid material is asphalt.

12. An anti-earthquake bearing apparatus of claim 1, wherein said fluid material is rubber.

13. An anti-earthquake bearing apparatus of claim 1, wherein said fluid material is gas including air.

14. An anti-earthquake bearing apparatus of claim 3, wherein said reinforced structure comprises a plurality of fiber-reinforced rubber layers attached to a surface of an innermost layer made of elastic material such as rubber by means of vulcanization.

* * * * *